US009816413B2

(12) United States Patent
Schmidt et al.

(10) Patent No.: US 9,816,413 B2
(45) Date of Patent: Nov. 14, 2017

(54) MUFFLER WITH INTERCONNECTED PIPES

(71) Applicant: FRIEDRICH BOYSEN GMBH & CO. KG, Altensteig (DE)

(72) Inventors: Jurgen Schmidt, Muhlacker (DE); Georg Turowski, Jettingen (DE)

(73) Assignee: FRIEDRICH BOYSEN GMBH & CO., KG, Altensteig (DE)

( * ) Notice: Subject to any disclaimer, the term of this patent is extended or adjusted under 35 U.S.C. 154(b) by 0 days.

(21) Appl. No.: 14/750,430

(22) Filed: Jun. 25, 2015

(65) Prior Publication Data

US 2016/0017776 A1 Jan. 21, 2016

(30) Foreign Application Priority Data

Jul. 18, 2014 (DE) ..... 10 2014 110 098

(51) Int. Cl.

| | |
|---|---|
| ***F01N 13/08*** | (2010.01) |
| ***F01N 13/18*** | (2010.01) |
| ***F01N 1/08*** | (2006.01) |
| ***F01N 1/00*** | (2006.01) |
| *F01N 13/00* | (2010.01) |

(52) U.S. Cl.

CPC ..... *F01N 1/084* (2013.01); *F01N 1/00* (2013.01); *F01N 13/185* (2013.01); *F01N 13/1844* (2013.01); *F01N 13/1872* (2013.01)

(58) Field of Classification Search

CPC ..... F01N 13/1805; F01N 13/1811; F01N 13/1838; F01N 13/185; F01N 13/1872; F01N 2260/10; F01N 2470/06; F16L 27/12; F16L 37/0841; F16L 41/18

USPC ..... 181/227, 228, 243, 282

See application file for complete search history.

(56) References Cited

U.S. PATENT DOCUMENTS 3,066,959 A * 12/1962 White ..... F16L 37/084 285/330

3,327,945 A * 6/1967 Pfister ..... F23L 11/02 110/147

(Continued)

FOREIGN PATENT DOCUMENTS

DE 3023758 A1 3/1981

DE 102009035738 A1 2/2011

(Continued)

*Primary Examiner* — Edgardo San Martin

(74) *Attorney, Agent, or Firm* — Amster, Rothstein & Ebenstein LLP

(57) ABSTRACT

A muffler, in particular a rear muffler, for an exhaust gas system of an internal combustion engine, in particular a motor vehicle engine, comprises a housing, in particular a housing having a jacket and two end walls, and comprises at least one first pipe, in particular an inlet or outlet pipe which is in particular led through the jacket and which is connected to a second pipe, in particular to an inner pipe. The second pipe comprises a pipe piece into which a pipe piece of the first pipe led through an opening of an inner support element is plugged in an axially displaceable manner. In this respect, the pipe piece of the first pipe is preferably provided with slits into which nubs engage which are provided at the inner boundary of the opening of the support element. The end section of the first pipe is expanded in its region plugged into the pipe piece of the second pipe to fix the first pipe at the support element.

17 Claims, 3 Drawing Sheets

(56) References Cited

U.S. PATENT DOCUMENTS 3,608,667 A * 9/1971 Foster ..... F01N 1/003 181/282
4,387,915 A 6/1983 Adickes
4,473,131 A * 9/1984 Clegg ..... F01N 13/1844 181/228
4,475,623 A * 10/1984 Gerber ..... F01N 13/1844 181/228
4,565,260 A * 1/1986 Scheidt ..... F01N 13/1805 181/243
4,570,747 A * 2/1986 Ortyl ..... F01N 13/185 181/243
4,821,391 A * 4/1989 Paterick ..... B21D 39/04 29/251
5,176,406 A * 1/1993 Straghan ..... E21B 17/046 285/24
5,290,974 A * 3/1994 Douglas ..... F01N 13/1805 181/228
5,477,015 A * 12/1995 Preslicka ..... B21D 39/04 181/243
5,579,577 A 12/1996 Preslicka et al.
5,705,777 A * 1/1998 Flanigan ..... F01N 1/24 181/252
7,617,909 B2 11/2009 Wolf
7,913,811 B2 * 3/2011 Andre ..... F01N 1/083 181/243
8,051,949 B2 11/2011 Henke et al.
8,205,713 B2 6/2012 Gorke et al.
8,292,026 B2 10/2012 Tauschek et al.
8,684,131 B1 4/2014 Park et al.
8,714,601 B2 * 5/2014 Kawamata ..... B21D 39/06 285/222
2011/0192676 A1 * 8/2011 Wirth ..... F01N 1/08 181/227
2012/0073271 A1 3/2012 Prather

FOREIGN PATENT DOCUMENTS

DE 102010014573 A1 10/2011
DE 102010019959 A1 11/2011

* cited by examiner

MUFFLER WITH INTERCONNECTED PIPES

FIELD OF THE INVENTION

The present invention relates to a muffler, in particular to a rear muffler, for an exhaust gas system of an internal combustion engine, in particular a motor vehicle engine, having a housing, in particular a housing having a jacket and two end walls, and having at least one first pipe, in particular an inlet pipe led through the jacket into the housing or an outlet pipe led out of the housing, said inlet or outlet pipe being connected to a second pipe, in particular to an inner pipe.

BACKGROUND OF THE INVENTION

Mufflers of this kind are generally known and are in particular used as standard in motor vehicles to reduce the noise level generated by the vehicle engine. They are as a rule provided with inner bases which support the inner pipes and separate different chambers from one another. These inner bases are in this respect usually designed as stiff. The inner pipes are as a rule welded to the respective base passage. In addition, the inner bases can also be welded from the outside to the jacket of the housing, for example, via a respective elongated hole.

High stresses arise due to different temperatures at the jacket and at gas-conducting pipes, the stresses either having to be taken up by the inner bases by deformation or having to be reduced by sliding seats between the pipes. The connections between the inlet pipes or the outlet pipes and the inner pipes are in particular problematic due to the different temperatures.

SUMMARY OF THE INVENTION

It is the underlying object of the invention to provide a muffler of the initially named kind which allows a reliable compensation of thermal expansions in the region of a connection between an inlet or outlet pipe and an inner pipe with a design which is kept as simple as possible.

This object is satisfied in accordance with the invention in that the second pipe has a pipe piece into which a pipe piece of the first pipe led through an opening of an inner support element is plugged in an axially displaceable manner, wherein the pipe piece of the first pipe is secured against rotation with respect to the support element and is expanded in its region plugged into the pipe piece of the second pipe to prevent a sliding of the first pipe out of the pipe piece of the second pipe. The pipe pieces of the first pipe and of the second pipe can in this respect each be formed by an end section or by a lateral branch of a straight or curved pipe. The end section of the first pipe is preferably provided with slits into which nubs engage which are provided at the inner boundary of the opening of the support element.

A reliable compensation of thermal expansions in the region of the connection between two pipes is made possible due to this design with a design of the muffler which is kept extremely simple. Thermal expansions are able to be compensated after the first pipe has admittedly been fixed by its expanded end region at the support element, but can be axially displaced to a limited degree relative thereto. The first pipe is secured against rotation as a result of the nubs at the inner boundary of the opening of the support element which engage into the slits of the end section. The respective connection can be established extremely simply. After a plugging together of the different elements has taken place, the first pipe can be expanded in a simple manner from the inside to fix the first pipe at the support element.

The slits of the pipe piece of the first pipe are preferably open toward the end face of the pipe piece facing the second pipe. After the slits of the first pipe have been aligned by a corresponding rotary position thereof with the nubs of the support element, the first pipe can be plugged through the support element into the second pipe so that the nubs are simultaneously introduced into the slits and the first pipe is secured against rotation.

It is also in particular of advantage when the pipe piece of the first pipe is provided with an intake, i.e. with a region-wide diameter reduction. Such an intake facilitates the axially displaceable reception of the pipe piece of the first pipe in the opening of the support element and forms an abutment for the moving into the second pipe.

It is also in particular of advantage when the second pipe is formed as a Y pipe and the pipe piece is provided as a lateral branch of the Y pipe. The connection to further inner pipes is simplified by such a Y pipe. In this respect, two further inner pipes can in particular be connected to such a Y pipe.

In accordance with a preferred practical embodiment of the muffler in accordance with the invention, the support element is provided at its side facing the second pipe with a collar which surrounds the opening of the support element and onto which the pipe piece of the second pipe is in particular plugged. The installation of the second pipe at the support element is thus in particular also simplified.

The expanded region of the pipe piece of the first pipe preferably engages behind the collar of the support element. The first pipe is thus fixed at the support element, i.e. connected to it in an unlosable manner, in a simple manner while maintaining a limited axial displaceability.

The support element can expediently comprise a support metal sheet.

It is also in particular of advantage when the support element extends between two inner bases arranged within the housing. The support element can in this respect be fixedly connected, in particular welded, to these inner bases.

As already mentioned, the second pipe connected to the first pipe can be connected to at least one further inner pipe.

At least some of the inner pipes can in particular be led through cut-outs provided in the inner bases and can be welded there and supported at these inner bases in this manner.

The jacket of the housing of the muffler can in particular be produced in a shell-like manner of construction or in a wrapped manner of construction. Whereas in particular two deep-drawn metal sheets are connected to one another at the marginal side in the shell-like manner of construction, a metal sheet is as a rule wrapped around a core and closed in the wrapped manner of construction.

BRIEF DESCRIPTION OF THE DRAWINGS

The invention will be explained in more detail in the following with reference to an embodiment and to the drawing; there are shown therein.

DETAILED DESCRIPTION

Figure 1:
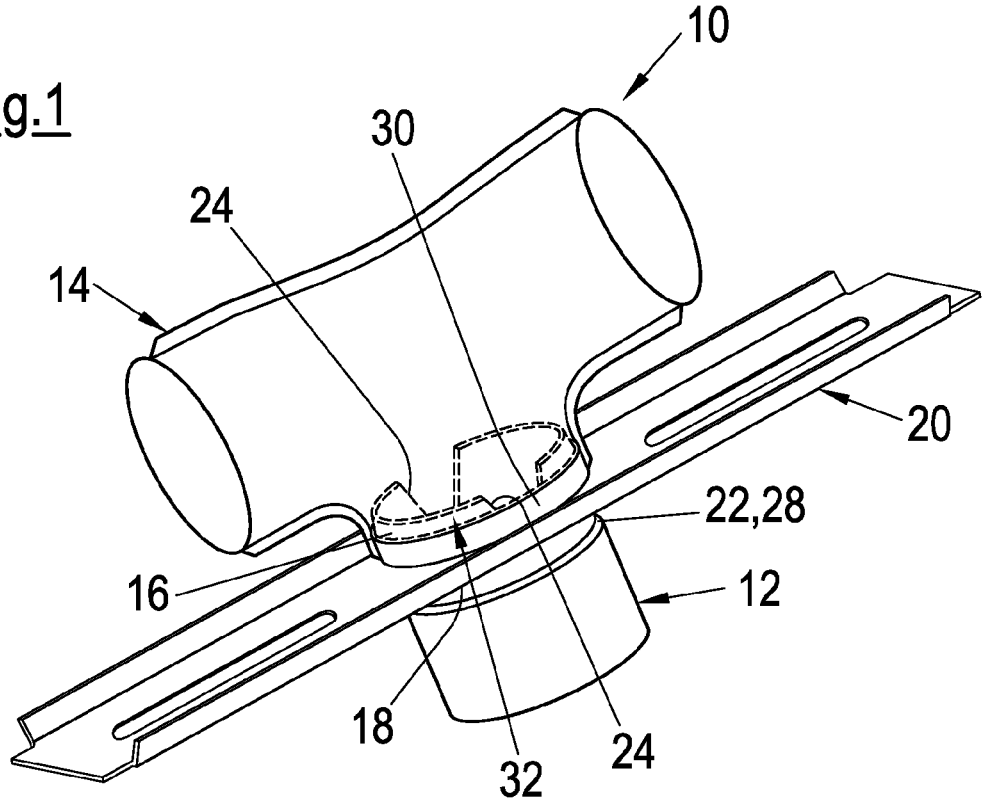
FIG. 1 a schematic perspective representation of a connection between an inlet or outlet pipe and an inner pipe of an exemplary embodiment of a muffler in accordance with the invention.

FIGS. 1 to 8 show in a schematic part representation an exemplary embodiment of a muffler 10 in accordance with the invention, in particular of a rear muffler, for an exhaust gas system of an internal combustion engine, in particular a motor vehicle engine, having a housing (not shown) comprising a jacket and two end walls and having at least one inlet or outlet pipe 12 which is in particular led through the jacket and which is connected to an inner pipe 14.

The inner pipe 14 has a pipe piece 16 which is formed as a lateral branch and into which an end section 22 of the inlet or outlet pipe 12 being led through an opening 18 of an inner support element 20 is plugged in an axially displaceable manner.

The end section 22 of the inlet or outlet pipe 12 is provided with slits 24 into which nubs 26 engage which are provided at the inner boundary of the opening 18 of the support element 20. The inlet pipe and the support element are hereby directly pressed so that a support effect similar to a welded solution is possible but the axial thermal expansion of the E pipe is simultaneously possible. The inlet region of the muffler is improved with respect to the possible bending load by this support effect. As can in particular be recognized with reference to FIG. 1, the end section 22 is expanded in its region plugged into the pipe piece 16 of the inner pipe 14 in the installed state to fix the inlet or outlet pipe 12 at the support element 20.

As can in particular be recognized with reference to FIGS. 1, 2, 6 and 7, the slits 24 of the end section 22 of the inlet or outlet pipe 12 are open toward the end face of the end section 22 facing the inner pipe 14. On the plugging of the inlet or outlet pipe 12 into the inner pipe 14 through the opening 18 of the support element 20, the nubs 26 can thus engage into the slits 24 so that the inlet or outlet pipe 12 is secured against rotation with respect to the support element 20.

The end section 22 of the inlet or outlet pipe 12 is provided with an intake 28, i.e. with a diameter reduction or a cross-section reduction, by which the axial displaceability of the end section 22 in the opening 18 of the support element 20 is made possible or facilitated and an abutment is created.

The inner pipe 14 can, as shown, in particular be formed as a Y pipe, with the pipe piece 16 being provided as a lateral branch of the Y pipe.

The support element 20 can be provided at its side facing the inner pipe 14 with a collar 30 which surrounds the opening 18 of the support element 20 and onto which the pipe piece 16 of the inner pipe 14 can in particular be plugged. As can in particular be recognized with reference to FIG. 1, the expanded region 32 of the end section 22 of the inlet or outlet pipe 12 engages behind the collar 30 of the support element 20 in the installed state so that the inlet or outlet pipe 12 is fixed at the support element 20, i.e. is connected in an unlosable manner thereto, while maintaining a limited axial displaceability.

The diameters or cross-sections of the inlet or outlet pipe 12 of the opening 18 of the support element 20 and of the pipe piece 16 of the inner pipe 14 are coordinated with one another. An outwardly gas-tight connection between the inlet or outlet pipe 12 and the inner pipe 14 is not necessary since the muffler housing is formed as gas-tight.

The support element 20 can in particular comprise a support metal sheet. This sheet can extend between two inner bases (not shown) arranged within the housing of the muffler 10. The support element 20 can in this respect be connected, in particular welded, to these inner bases.

The inner pipe 14 connected to the inlet or outlet pipe 12 can be connected to at least one further inner pipe, in the case of a design as a Y pipe, for example, to two further inner pipes.

At least some of the inner pipes can be supported by inner bases which are provided with cut-outs through which the respective inner pipes are led. The respective inner pipes can in particular again be welded to these inner bases.

The jacket of the housing can in particular be produced in a shell-like manner of construction or in a wrapped manner of construction. Whereas in particular two deep-drawn metal sheets are connected to one another at the marginal side in the shell-like manner of construction, a metal sheet is wrapped around a core and closed in the wrapped manner of construction.

FIG. 1 shows the final connection between the inlet or outlet pipe 12 and the inner pipe 14 after installation has been completed.

Figure 2:
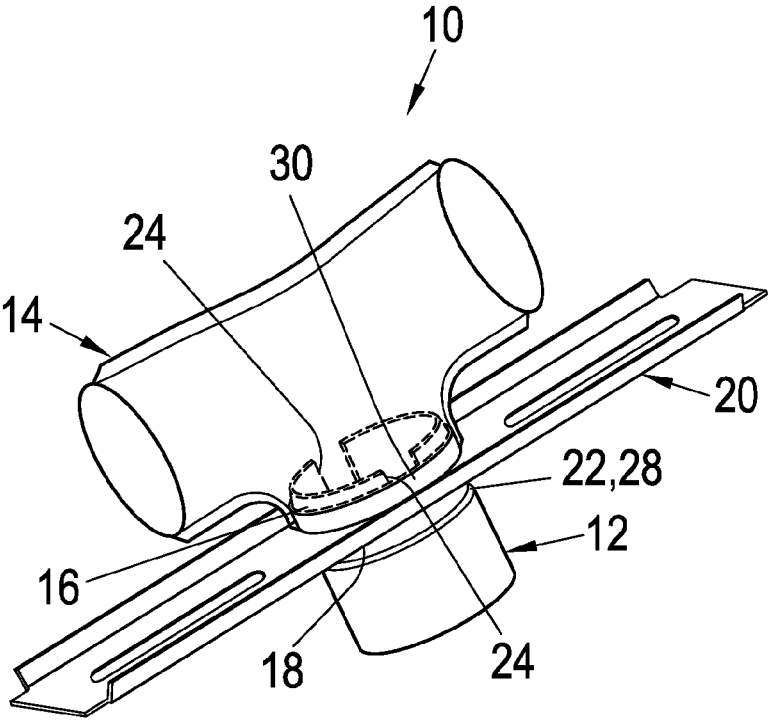
FIG. 2 a schematic perspective representation of the connection in accordance with FIG. 1 in a phase in which an end section of the inlet or outlet pipe has admittedly already been plugged into the pipe piece of the inner pipe, but the region of the end section of the inlet or outlet pipe plugged into the pipe piece of the inner pipe has not yet been expanded to fix the inlet or outlet pipe at the support element.

This connection is shown in FIG. 2 in a phase in which the end section 22 of the inlet or outlet pipe 12 has admittedly already been plugged into the pipe piece 16 of the inner pipe 14, but the region of the end section 22 of the inlet or outlet pipe 12 plugged into the pipe piece 16 of the inner pipe 14 has not yet been expanded to fix the inlet or outlet pipe 12 at the support element 20.

Figure 3:
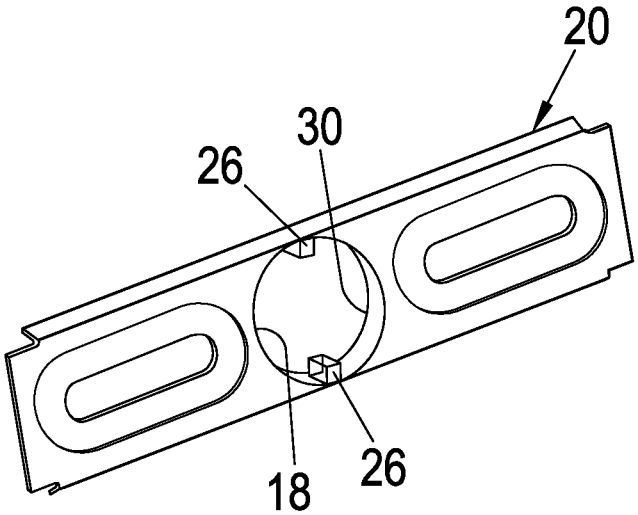
FIG. 3 a schematic perspective representation of the inner support element of the muffler.
Figure 4:
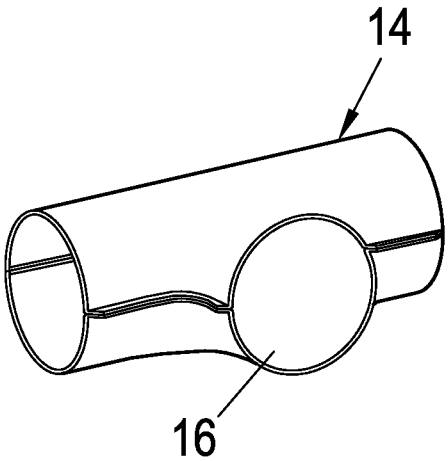
FIG. 4 a schematic perspective representation of the inner pipe of the muffler.
Figure 5:
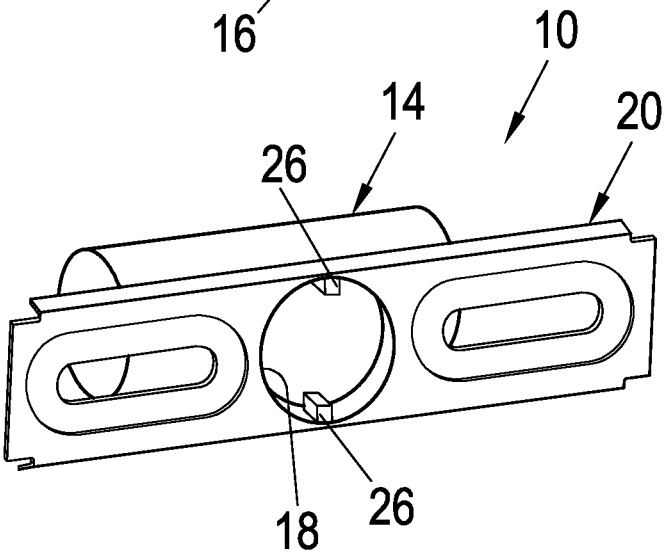
FIG. 5 a schematic perspective representation of the support element and of the inner pipe of the muffler plugged thereto.

FIG. 3 shows the inner support element 20 of the muffler 10. The inner pipe 14 of the muffler 10 is shown in a schematic perspective representation in FIG. 4. FIG. 5 shows the support element 20 and the inner pipe 14 of the muffler 10 connected thereto.

Figure 6:
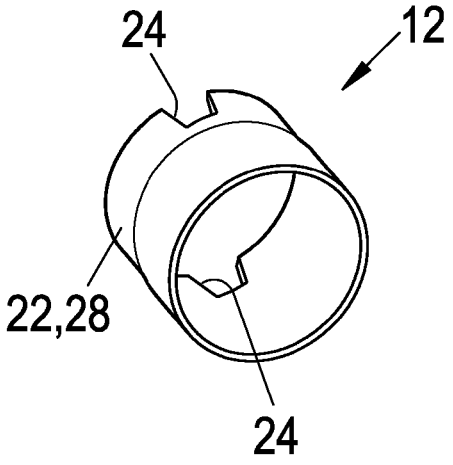
FIG. 6 a schematic perspective view of the inlet or outlet pipe of the muffler, with the end of the end section of the inlet or outlet pipe entering into the inner pipe being shown in the not yet expanded state.

FIG. 6 shows the inlet or outlet pipe 12 of the muffler 10 in a schematic perspective view, with the end of the end section 22 of the inlet or outlet pipe 12 entering into the inner pipe 14 being shown in a not yet expanded state.

Figure 7:
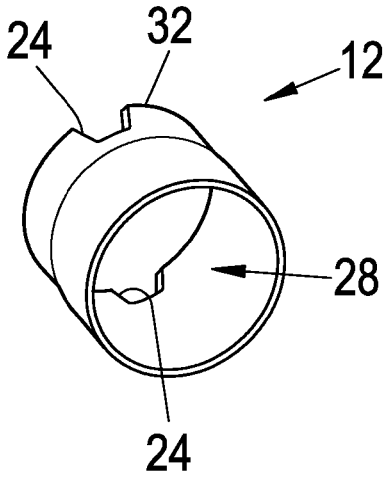
FIG. 7 a representation of the inlet or outlet pipe which is comparable with FIG. 6, with the end of the end section of the inlet or outlet pipe entering into the inner pipe being shown, however, in the expanded state.
Figure 8:
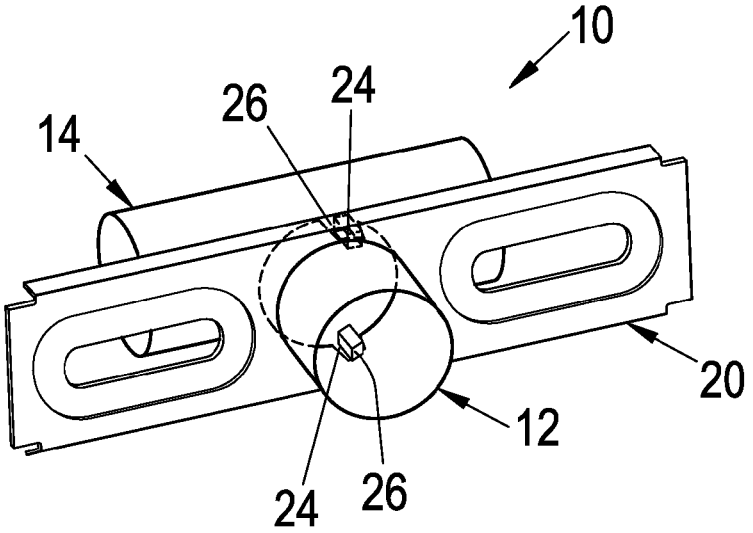
FIG. 8 a further schematic perspective representation of the connection between the inlet or outlet pipe and the inner pipe after installation has been completed.

FIG. 7 shows a representation of the inlet or outlet pipe 12 which is comparable with FIG. 6, with the end of the end section 22 of the inlet or outlet pipe 12 entering into the inner pipe 14 being shown, however, in the expanded state. FIG. 8 shows a further schematic perspective representation of the connection between the inlet or outlet pipe 12 and the inner pipe 14 after installation has been completed.

REFERENCE NUMERAL LIST

10 muffler
12 inlet or outlet pipe
14 inner pipe
16 pipe piece
18 opening
20 inner support element
22 end section
24 slit
26 nub
28 intake
30 collar
32 expanded region

The invention claimed is:

1. A muffler for an exhaust gas system of an internal combustion engine, having a housing and having at least one first pipe and a second pipe, the first pipe connected to the second pipe, the first pipe comprising a pipe piece and the second pipe comprising a pipe piece, the pipe piece of the first pipe extending through an opening of an inner support element of the muffler and into the pipe piece of the second pipe, the pipe piece of the first pipe secured against rotation with respect to the support element, the pipe piece of the first pipe having an expanded section within the second pipe which prevents a sliding of the first pipe out of the pipe piece of the second pipe, the first pipe further having a section of reduced diameter between the expanded section and an abutment at the first pipe, wherein the first pipe is axially displaceable relative to the second pipe between the expanded section and the abutment.

2. The muffler in accordance with claim 1, wherein the housing has a jacket and two end walls.

3. The muffler in accordance with claim 1, wherein the at least one first pipe is an inlet pipe led through the jacket into the housing or an outlet pipe led out of the housing.

4. The muffler in accordance with claim 3, wherein the second pipe is an inner pipe.

5. The muffler in accordance with claim 1, wherein the pipe piece of the first pipe is provided with slits into which nubs engage which are provided at the inner boundary of the opening of the support element.

6. The muffler in accordance with claim 5, wherein the slits of the pipe piece of the first pipe are open toward the end face of the pipe piece facing the second pipe.

7. The muffler in accordance with claim 1, wherein the pipe piece of the first pipe is provided with an intake.

8. The muffler in accordance with claim 1, wherein the second pipe is formed as a Y pipe and the pipe piece is provided as a lateral branch of the Y pipe.

9. The muffler in accordance with claim 1, wherein the support element is provided at its side facing the second pipe with a collar which surrounds the opening of the support element.

10. The muffler in accordance with claim 9, wherein the pipe piece of the second pipe is plugged onto the collar.

11. The muffler in accordance with claim 9, wherein the expanded region of the pipe piece of the first pipe engages behind the collar of the support element.

12. The muffler in accordance with claim 1, wherein the support element comprises a support metal sheet.

13. The muffler in accordance with claim 1, wherein the support element extends between two inner bases arranged within the housing.

14. The muffler in accordance with claim 1, wherein the second pipe connected to the first pipe is connected to at least one further inner pipe.

15. The muffler in accordance with claim 1, wherein at least some of the pipes are inner pipes that are supported by inner bases which are provided with cut-outs through which the respective inner pipes are led.

16. The muffler in accordance with claim 2, wherein the jacket of the housing is produced in a shell-like manner of construction.

17. The muffler in accordance with claim 2, wherein the jacket of the housing is produced in a wrapped manner of construction.

* * * * *